US008051569B2

(12) United States Patent
Kawaguchi et al.

(10) Patent No.: US 8,051,569 B2
(45) Date of Patent: Nov. 8, 2011

(54) METHOD OF BUILDING A BOILER FRAME

(75) Inventors: Shigeyoshi Kawaguchi, Chiyoda-ku (JP); Motoshi Horinouchi, Chiyoda-ku (JP); Shinichi Sagawa, Chiyoda-ku (JP); Yoshitaka Masuda, Chiyoda-ku (JP); Masakatsu Imamura, Kure (JP); Minoru Sakino, Kure (JP); Yasuaki Kawashima, Kure (JP)

(73) Assignees: Hitachi Plant Technologies, Ltd., Tokyo (JP); Babcock-Hitachi Kabushiki Kaisya, Tokyo (JP)

( * ) Notice: Subject to any disclaimer, the term of this patent is extended or adjusted under 35 U.S.C. 154(b) by 1318 days.

(21) Appl. No.: 11/669,106

(22) Filed: Jan. 30, 2007

(65) Prior Publication Data

US 2008/0028722 A1 Feb. 7, 2008

(30) Foreign Application Priority Data

Feb. 6, 2006 (JP) ..... 2006-028883

(51) Int. Cl.
*B21D 47/00* (2006.01)

(52) U.S. Cl. ..... 29/897.312; 29/897; 29/897.3; 29/897.31; 52/745.03; 52/745.05

(58) Field of Classification Search ..... 29/897.3, 29/897.312, 897.31; 52/745.13, 745.01, 52/745.03, 125.1, 126.5, 745.05; 254/89 R, 254/106
See application file for complete search history.

(56) References Cited

U.S. PATENT DOCUMENTS 3,053,015 A * 9/1962 Graham ..... 52/745.13

FOREIGN PATENT DOCUMENTS

JP 2932818 B 8/1993

* cited by examiner

*Primary Examiner* — Richard Chang
(74) *Attorney, Agent, or Firm* — Oliff & Berridge, PLC

(57) ABSTRACT

New and useful method of building a boiler frame significantly reduces the use of high load-lifting height crane and improves the operation efficiency despite bad weather. Multiple levels of steel supporting posts, which are established beforehand, are linked together with their top portion by beams and the 9th floor unit is fixed to the posts at an intermediate floor position temporarily. Suspension rods, which are suspended from lifting jacks, are then connected to the 8th floor unit and jacked up, while floor units made for lower than the 8th floor are connected on the ground to form a multi-floor unit. After connecting the multi-floor unit to the 9th floor unit the temporary fixation is released, the multi-floor unit is lifted up, and each floor unit is permanently fixed to the designated floor position repeatedly and respectively.

2 Claims, 11 Drawing Sheets

METHOD OF BUILDING A BOILER FRAME

CLAIM OF PRIORITY

The present application claims priority under the Paris Convention from Japanese Application 2006-028883 filed on Feb. 6, 2006, the contents of which are hereby incorporated by reference into this application.

FIELD OF THE INVENTION

The present invention relates to a method of building a boiler frame and more specifically to a method of building a boiler frame of a large scale boiler for a thermal power plant.

DESCRIPTION OF THE RELATED ART

A boiler frame of a large scale boiler for a thermal power plant is a gigantic construction with a height of 60 to 100 meters. As a method of building a boiler frame, it is common to attach unit parts (such as braces, medium beams, small beams, joists, gratings, handrails etc.) respectively to the designated positions by lifting and carrying them to each respective floor, after the completion of building an overall framework with steel supporting posts and large beams. However, this type of serial construction process requires a large part of the construction work to be done at a high altitude, and also requires a large amount of labor and time for transportation of the unit parts with a crane. As a result, the efficiency of the operation decreases, while the construction costs as well as the required time for completing the construction increases.

In order to reduce the construction costs, the opportunity to adopt a block construction method has recently been implemented. A Japanese Patent No. 2,932,818 discloses one example of the block construction method. With the block construction method, posts, large beams, brace, medium beams, small beams, joists, gratings, handrails etc. are all pre-fabricated to be a specific block unit at an internal assembly factory, and the blocks are stacked at the construction site by a crane.

In the case of the block construction method, the blocks are pre-fabricated at the internal assembly factory on the ground where the efficiency of the operation is high. With the block construction method, the required time for completing the construction has become shorter since the assembling and stacking processes of each block from the lower floor to the higher floor can be implemented in conjunction at the same time.

However, the conventional block construction method is not without its problems. A high load-lifting height crane for lifting the blocks at the construction site is required and the weight and size of the blocks are limited by the capacity of the crane. Moreover, the construction is often forced to be suspended due to bad weather conditions. Operating the crane in an area with strong wind or falling snow would deem it to be too dangerous to continue the operation.

SUMMARY OF THE INVENTION

The objective of the invention is to provide a method of building a boiler frame with minimum usage of a high load-lifting height crane, with less restriction of block weight and size, and with improved efficiency of operation in a bad weather, by improving the problems identified in the above prior art.

In order to achieve the objective, the method of building a boiler frame according to the present invention connects tops of multiple of steel supporting posts established in advance with beams, and temporally fixes a floor unit of upper floor at the lower middle floor. A multi-floor unit is formed by connecting a lower floor unit to the temporally fixed upper floor unit. Then, the boiler frame is build by repeating operations that the temporally fixation is released, the multi-floor unit is lifted, and then each floor unit is fixed to its designated floor.

Furthermore, it is possible that the method of building a boiler frame includes a first step installing a lifting jack on top of a linked beam connected between tops of multiple of steel supporting posts, while the supporting posts that are a part of the boiler frame are being extended to a top floor level, and a top floor unit is temporally fixed to the height corresponding to an intermediate floor; a second step for forming a multi-floor unit by connecting a lower floor unit designed to become lower than the top floor together on the ground while a traction device suspended from the lifting jack is lifting the top floor unit; a third step for connecting the multi-floor unit formed in the second step with the top floor unit, wherein the multi-floor unit is lifted by the lifting jack; a fourth step for temporally fixing a lower side floor unit to an intermediate floor position of the steel supporting posts, and disengaging the lower side floor unit from the multi-floor unit; and a fifth step for releasing the temporally fixing of the top floor unit and jacking up a multi-floor unit consisting of the top floor unit and at least one of lower floor units, and permanently fixing each floor unit of the multi-floor unit to respective designated positions. The lifting jack is desirable to be a center-hole type jack.

According to the method of present invention, each floor unit can be fixed to each designated floor position in a condition of securing the strength of a steel frame assembly structure by temporally fixing a floor unit to a intermediate floor of multiple of steel supporting posts, after lifting a heavily loaded multiple floor unit as a whole with a lifting jack or other devices. Furthermore, this method significantly reduces the need for working at high altitudes since the multiple of floor units are assembled on the ground side at the second step.

Therefore, according to the present invention, the usage of the high load-lifting height crane is minimized and each pre-fabricated floor unit are fixed to the designated floor sequentially with high efficiency and safely. And a method of building a boiler frame is achieved with the reduced restriction to the weight and size of the floor unit as a block since the usage of the high load-lifting height crane is not necessary after the second step and with the improved operability even in a bad weather.

DETAILED DESCRIPTION OF THE PRESENT EMBODIMENTS

Figure 1:
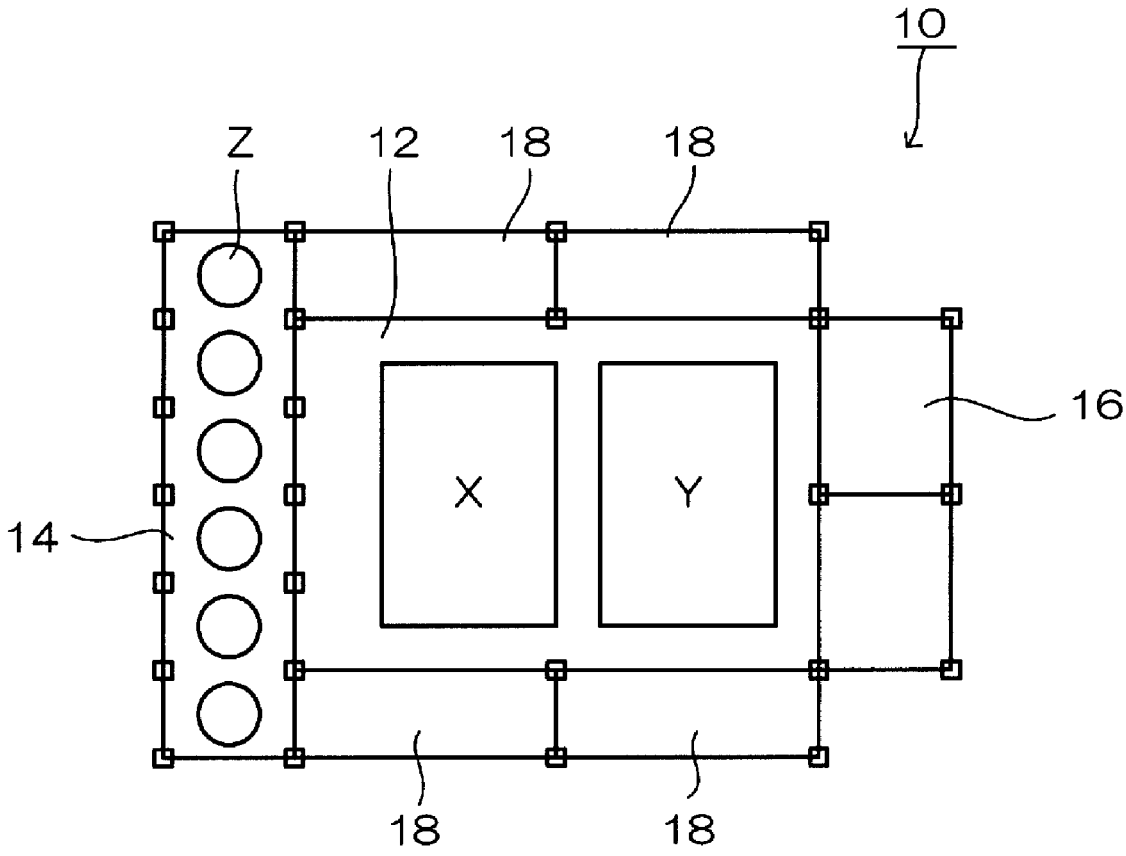
FIG. 1 is a plan view for indicating the general construction of a charcoal burning boiler frame as an example.
Figure 2:
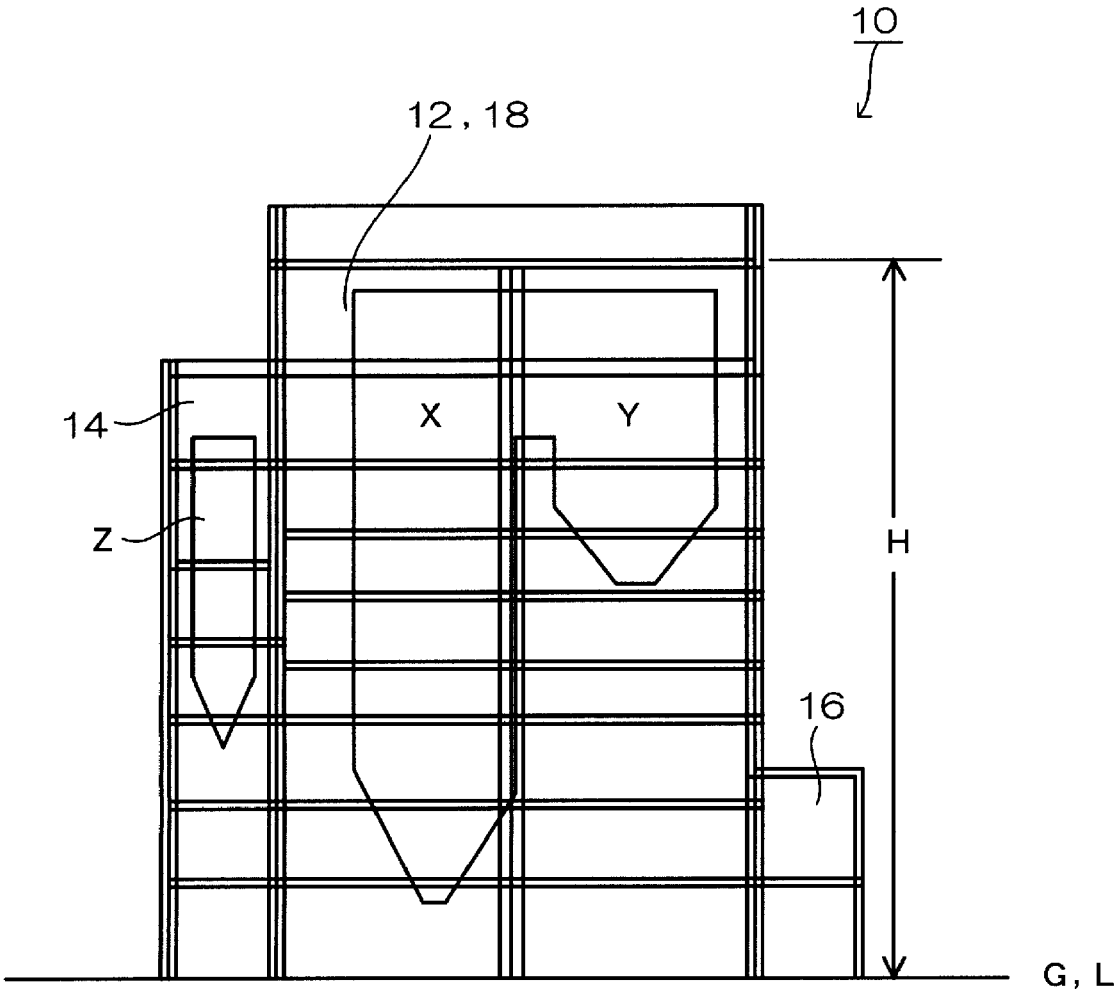
FIG. 2 is a plan view for indicating the general construction of a charcoal burning boiler frame as an example.

Together with the drawings attached, an embodiment of the present invention is explained. FIG. 1 is a plan view for indicating the general construction of a charcoal burning boiler frame as an example, and FIG. 2 is a side view of the same.

Boiler frame 10 consists of a center portion 12 with boiler furnace walls X and cage walls Y etc., a front potion 14 with a coal bunker X, a rear portion 16 with a pre-heating device, and a side portion 18 to become a operation maintenance area for equipments deployed in the center portion 12 with small devices and a pipeline.

Within the construction of the boiler frame 10, especially the side portion 18 is the most suitable place for applying the method of building a boiler frame according to the present invention. The side portion 18, for example, reaches the height of 75 meters with nine floors. With the quadripartite side portion 18, the method of building a boiler frame according to the present invention is applicable to each of the quadrants. In the case that the method of building a boiler frame according to the present invention is applied to one quadrant of the side portion 18 will be explained in this specification.

Figure 3:
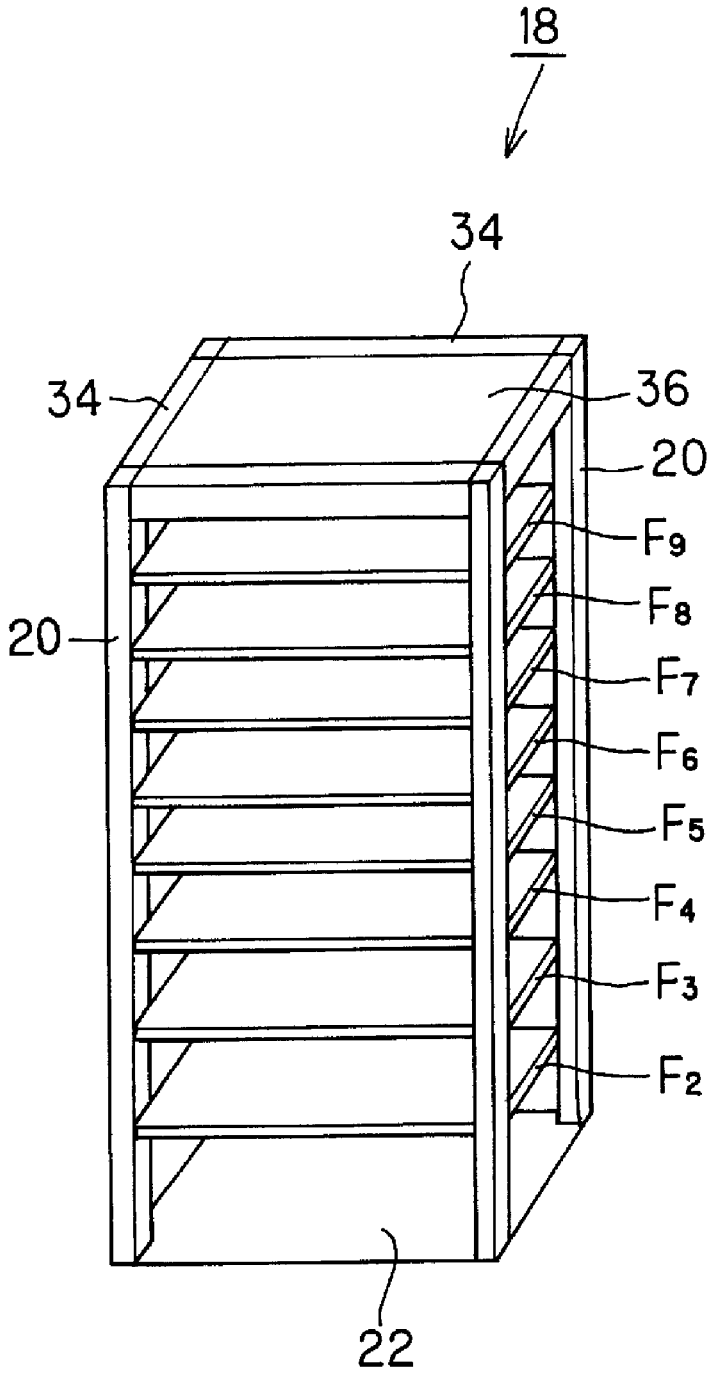
FIG. 3 is a perspective schematic indicating the completion status of a quadrant of a side portion 18.

FIG. 3 is a schematic perspective view of the completion status of one quadrant of the side portion 18. Each of floor units of the 2nd floor $F_2$ to the 9th floor (the top floor) $F_9$ is fixed to respective designated floor relative to four steel supporting posts 20 stood from a ground floor 22. Top portions of four steel supporting posts 20 are linked with large beams 34, 34 and form a top portion area 36.

Figure 4:
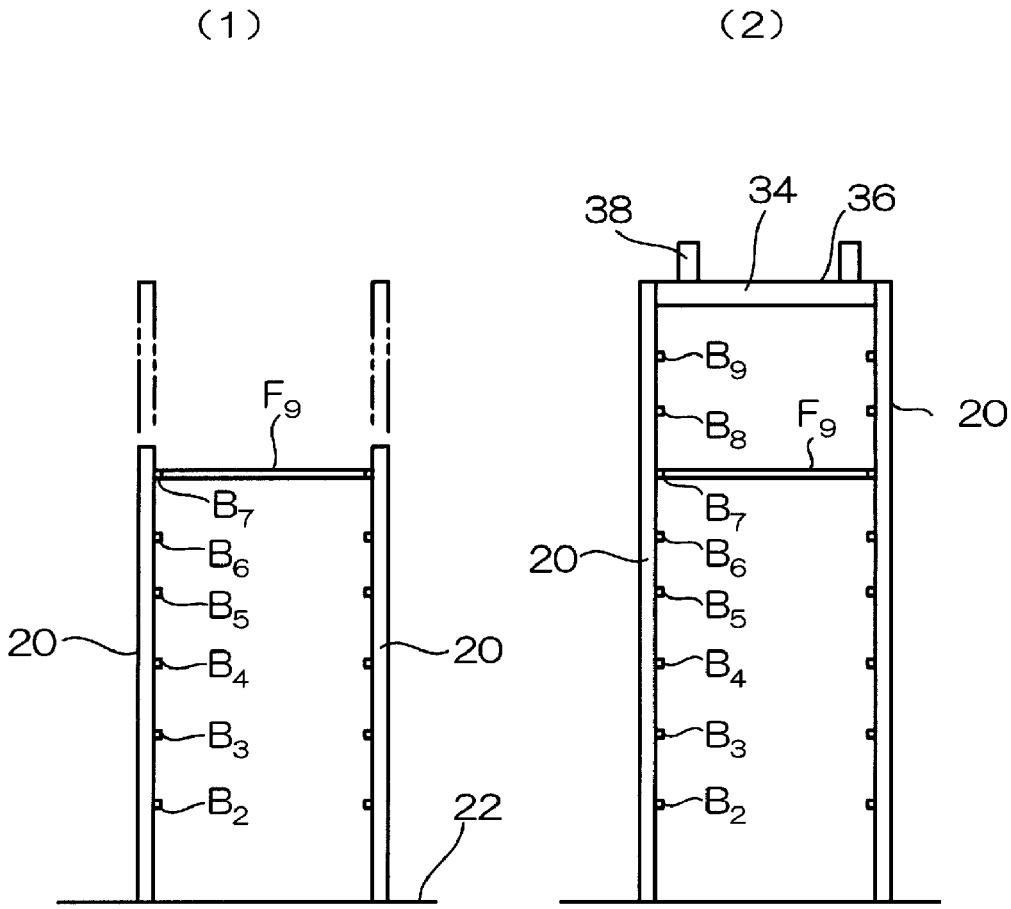
FIG. 4 shows side views for the first step of an embodiment according to the present invention for building the side portion 18.

FIG. 4 is a side view showing the first step for building a side portion 18. First of all, the steel supporting posts 20 are established from the ground floor 22. Brackets $B_2$-$B_9$ for fixing each floor units $F_2$-$F_9$ are attached to the steel supporting posts 20. The pre-fabricated (at an internal assembly factory) top floor of the 9th floor unit $F_9$ is temporally fixed to the brackets $F_7$ for the 7th floor when the steel supporting posts 20 have been reached to an intermediate floor height as seen with FIG. 4 (1).

Figure 5:
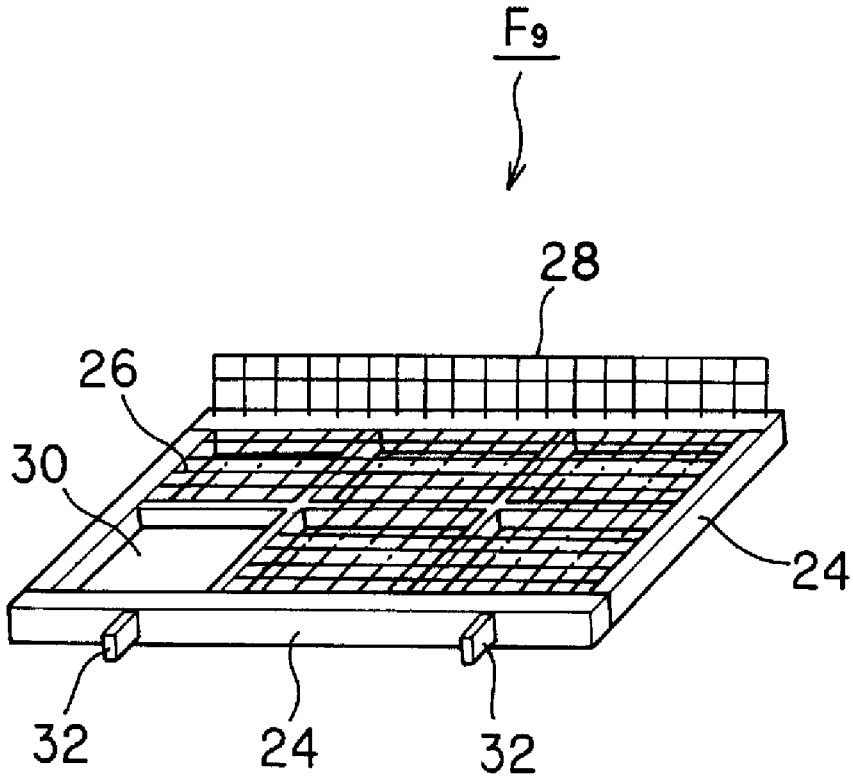
FIG. 5 shows a perspective view of the 9th floor unit $F_9$.

FIG. 5 shows a perspective view of the 9th floor unit $F_9$. As seen in the drawing, the 9th floor unit $F_9$ has large beams 24 in its four sides for linking to each of the steel supporting posts 20. Within a section surrounded by the large beams 24, a floor 26 is formed with meddle beams, small beams, joists and gratings, as well as handrails where necessary. When needed, an opening portion 30 is formed for accommodating a staircase (not shown), ducts or pipelines. Additionally, it is also possible to attach small equipments, ducts, pipelines etc. to be positioned upper and lower sides of the 9th floor unit $F_9$.

The longer sides of the large beams 24 have lifting posts 32 protruded outside to be used when the 9th floor unit $F_9$ is lifted by lifting jacks 38. When 9th floor unit $F_9$ is fixed temporarily to an intermediate floor as shown with FIG. 4(1), after the lifting posts 32 are engaged with lifting ropes suspended from a crane, the 9th floor unit $F_9$ is suspended and transported toward the position where blackest $B_7$ are located. Then the four corners of the 9th floor unit $F_9$ are fixed to the brackets $B_7$ temporarily. With this temporally attachment of the 9th floor unit $F_9$, the strength of the frame beam structure significantly improves.

As explained later, the structure of each floor unit $F_8$-$F_2$ is similar to that of the 9th floor unit $F_9$, and floors 26, handrails 28, lifting parts 32, pipelines are made in the internal assembly factory respectively, then to be carried to the construction site at respective designated timing.

At the first step, each steel supporting post 20 is extended toward the top floor from the status indicated in FIG. 4 (1) to FIG. 4 (2). Thereafter, each top of the steel supporting posts 20 are connected by large beams 34 to form the top area 36. Then the lifting jack 38 is installed at the top area 36.

Figure 6:
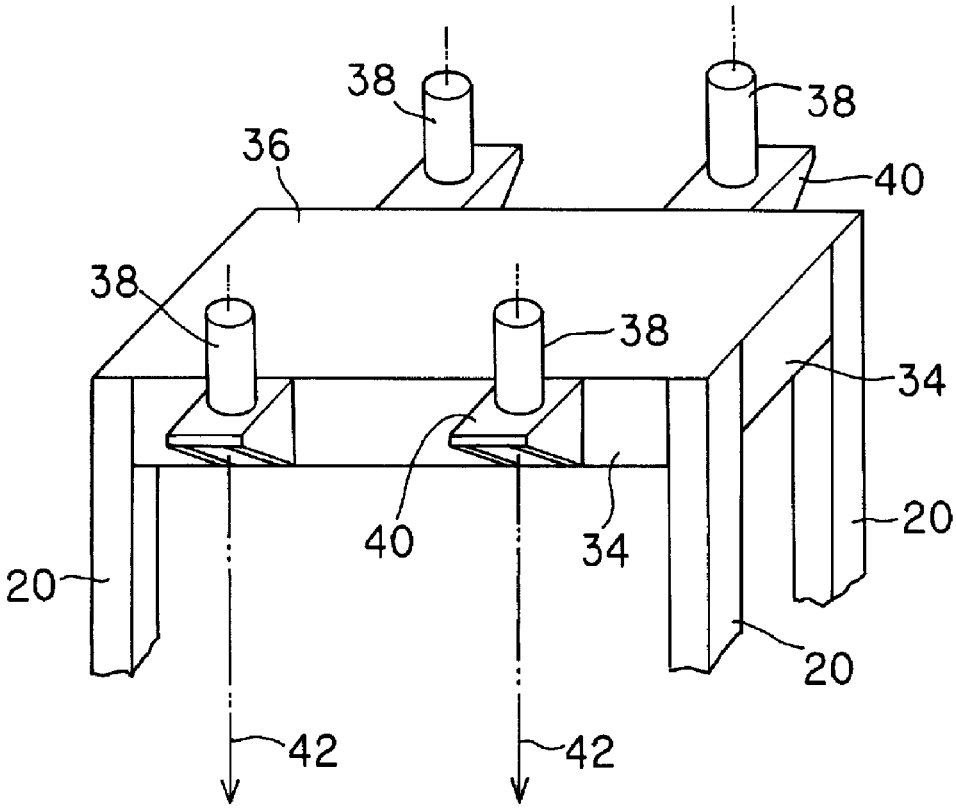
FIG. 6 shows a perspective view of the installation condition of lifting jacks 38.

FIG. 6 shows a perspective view of the installation condition of lifting jacks 38. Four jack bases 40 protruded outside are attached to the top area 36, and the center-hole type lifting jacks 38 are installed on each jack bases 40. The center-hole type lifting jack is a lifting jack with a suspension rod 42 made by connecting unit rods screwed together whose unit length is several tens of centimeters that is equivalent to one or several strokes; and the lifting jack 38 move the suspension rod 42 going through a center hole of the center-hole type lifting jack 38 up and down in a stroke by stoke fashion with a hydraulic pressure activation mechanism. Since it is easier to form a long suspension rod 42 by selecting a number of connecting unit rods, it is preferable to for configuring the high load-lifting height jack means. By engaging the suspension rods 42 with each lifting portions 32 of the floor unit $F_2$-$F_9$, each floor unit $F_2$-$F_9$ is jacked up respectively.

Figure 7:
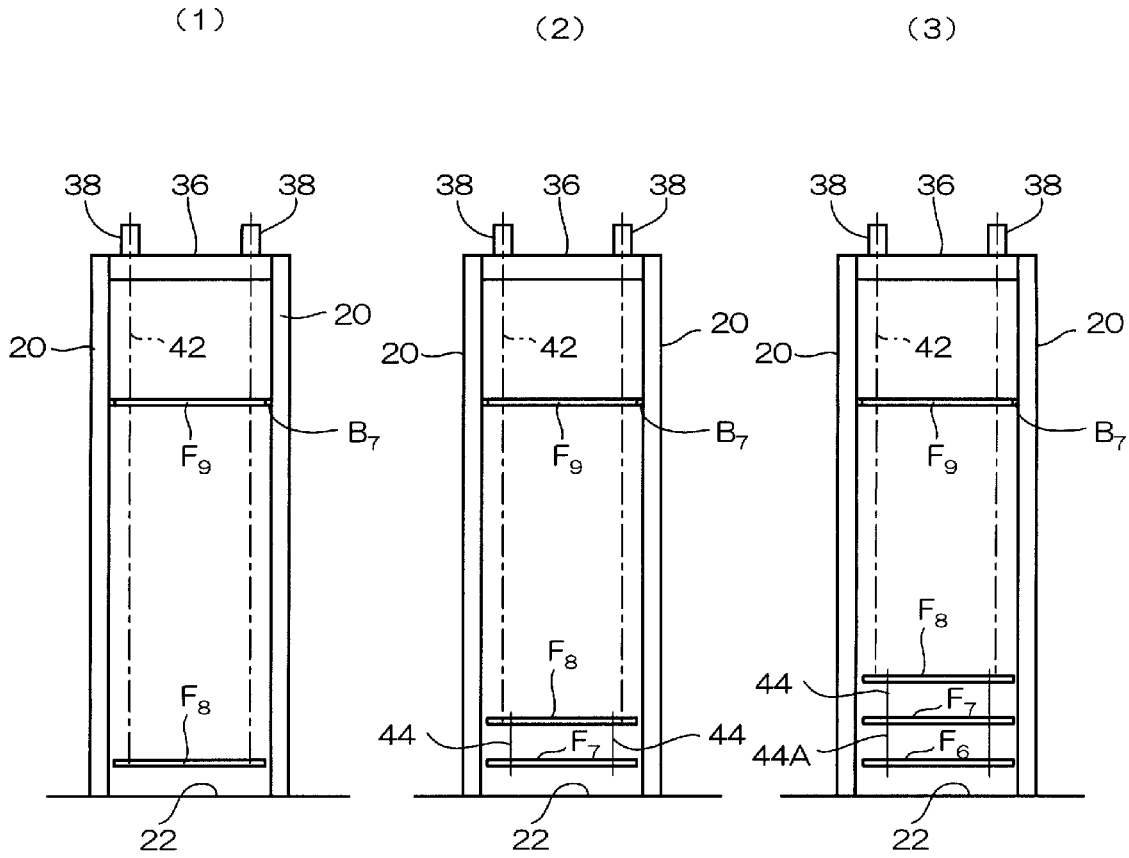
FIG. 7 shows side views for the second step of the embodiment.

FIG. 7 shows a side views for the second step of the embodiment. It should be born in mind that certain portions of the brackets $B_2$-$B_9$ are omitted in the drawing for simplification purpose in FIG. 7 as well as FIGS. 8 through 11. During the second step, the suspension rods 42 suspended from the lifting jacks 38 are engaged with the 8th floor unit F8 on the ground floor 22 as shown in FIG. 7 (1) at first. Then, the 7th floor unit $F_7$ is connected with linking devices 44 to the bottom of the 8th floor unit F8 at the ground floor, after the 8th floor unit F8 is jacked up by one floor height with the lifting jack 38 as shown in FIG. 7 (2). Then, the 6th floor unit $F_7$ is connected with linking devices 44A to the bottom of the 7th floor unit $F_7$ at the ground floor, after the double-floor unit of 8th floor unit and 7th floor unit is jacked up by one floor height with the lifting jack 38 as shown in FIG. 7 (3). As a result, the triple-floor unit is formed by linking 8th floor unit $F_8$, 7th floor unit $F_7$ and 6th floor unit $F_6$.

Figure 8:
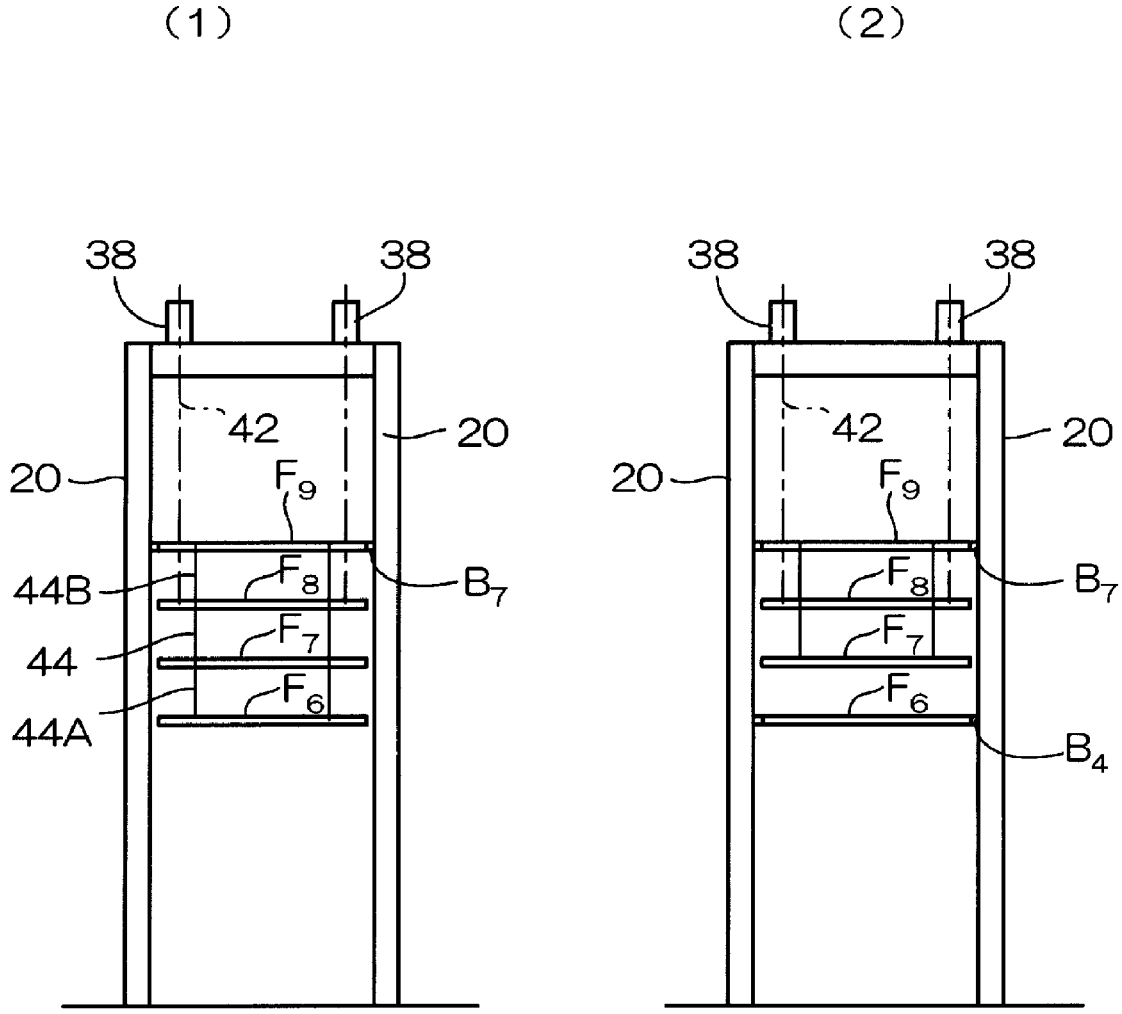
FIG. 8 shows side views for the third and fourth steps of the embodiment.

FIG. 8 shows side views for the third and fourth steps of the embodiment. During the third step, the 8th floor unit $F_8$ is connected with linking devices 44B to the 9th floor unit that is fixed to the brackets $B_7$ temporarily beforehand, after the multi-floor unit connected at the second step is jacked up by the lifting jack 38 as shown in FIG. 8 (1). During the fourth step, the lowest floor unit of the 6th floor unit $F_6$ out of several floor units within the multi-floor unit is fixed to the brackets $B_4$ located in the middle height position temporarily, then the 6th floor unit $F_6$ is disconnected from the 7th floor unit $F_7$ by disengaging the linking devices 44A as shown in FIG. 8 (2).

Figure 9:
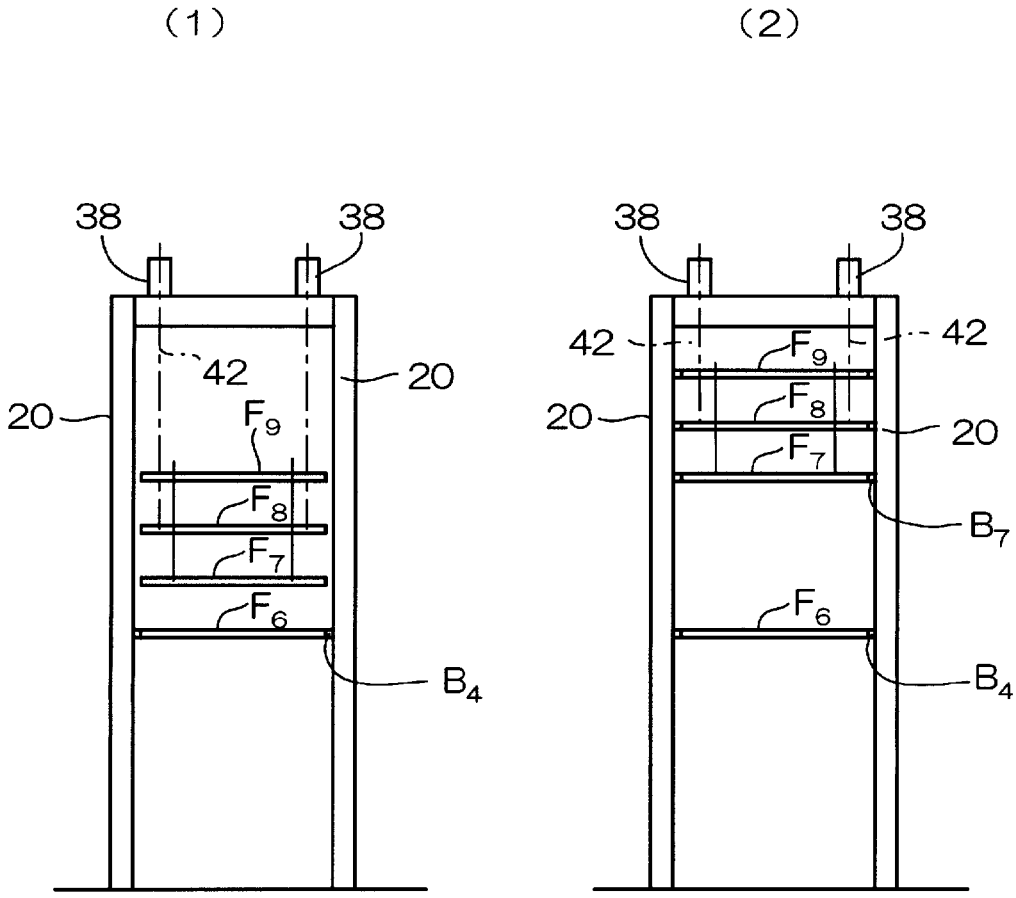
FIG. 9 shows side views for the fifth and sixth steps of the embodiment.

FIG. 9 shows side views for the fifth and sixth steps of the embodiment. First of all, the temporally fixation of the 9th floor unit $F_9$ with the bracket $B_7$ is released as shown in FIG. 9 (1). As a result, the load of the floor unit $F_9$ is shifted from the brackets $F_7$ side to the suspension rods 42 side. As the 6th floor unit $F_6$ is temporally fixed to the brackets B4 already at the fourth step, the four steel supporting rods 20 are lined together with the 6th floor unit $F_6$, the strength of the steel frame structure is secured. Then, after the multi-floor unit consisting of the floor unit $F_9$, $F_8$ and $F_7$ as a whole is jacked up, each floor unit is fixed to the designated floor respectively as shown in FIG. 9 (2). By fixing the floor units $F_9$, $F_8$ and $F_7$, the steel frame structure is reinforced step by step and more and more.

Figure 10:
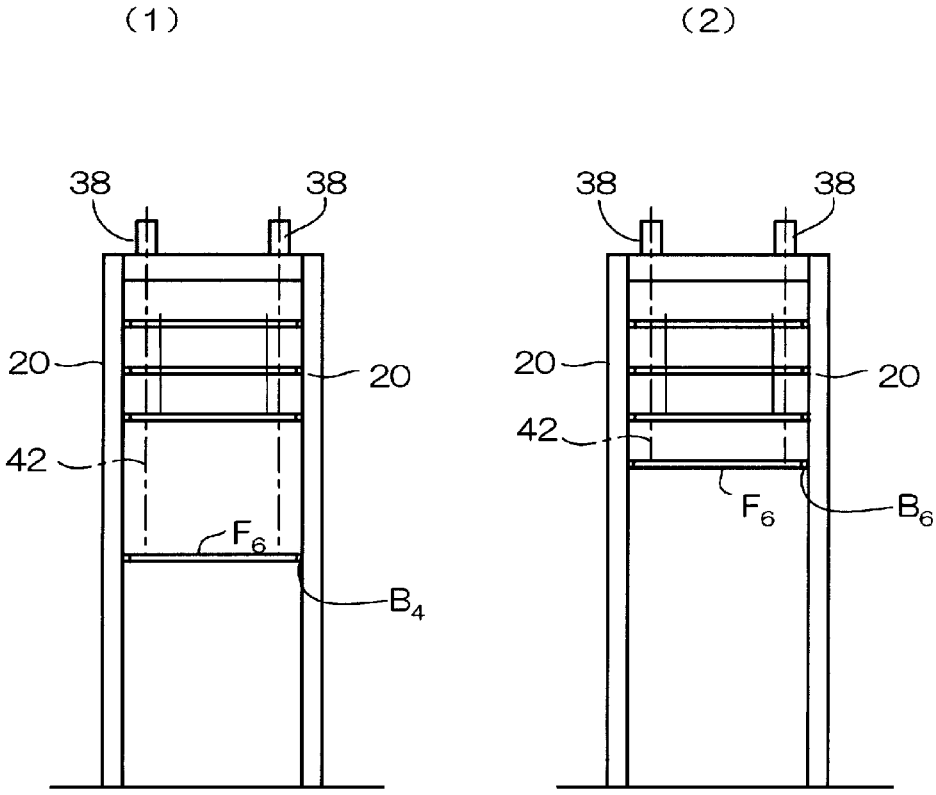
FIG. 10 shows side views for the seventh step of the embodiment.
Figure 11:
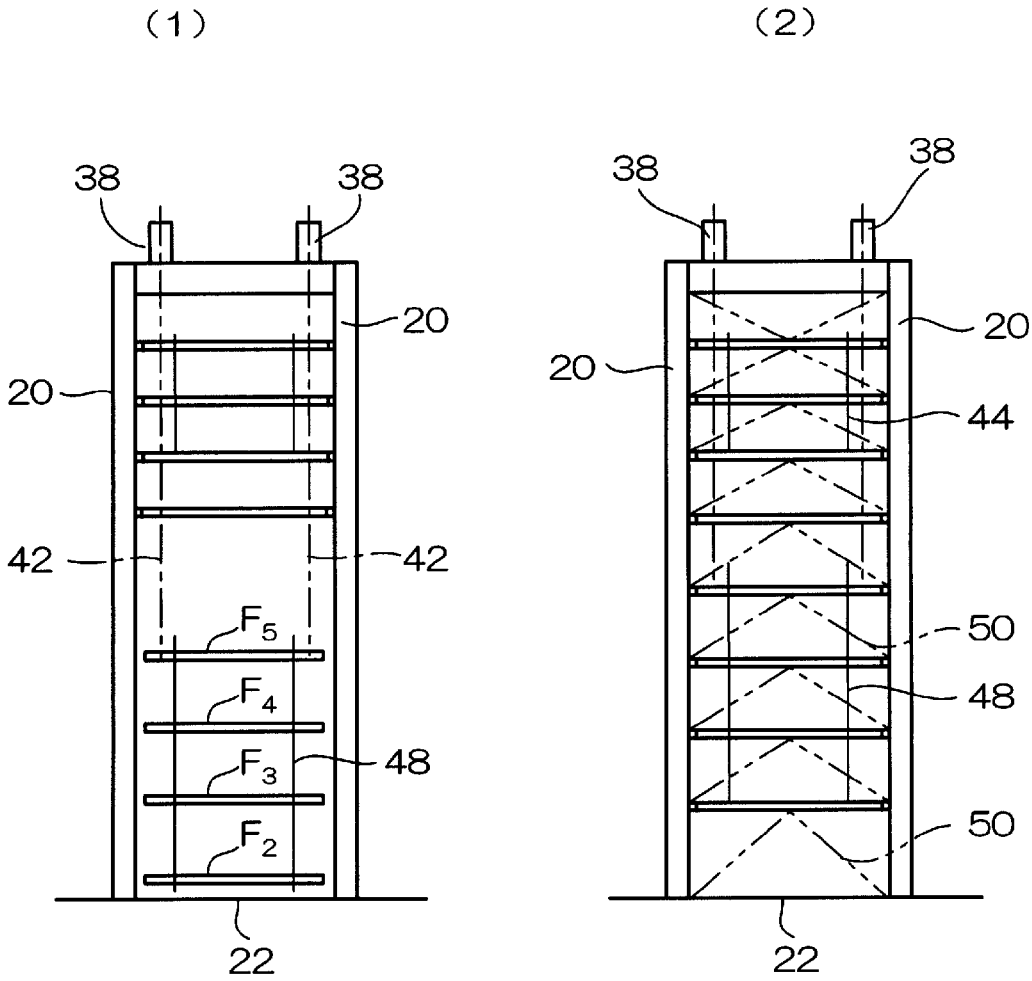
FIG. 11 shows side views for the eighth step of the embodiment.

Accordingly, the fixation of lower floor side floor units can be done relatively freely with its convenience. FIGS. 10 and 11 show side views of the sixth and seventh steps respectively. During the sixth step, the temporally fixation of the sixth floor unit $F_6$ with the bracket $B_4$ is released after the connection points of the suspension rods 42 is switched from the 9th floor unit $F_9$ to the 6th floor unit $F_6$, as shown in FIG. 10 (1). Then the 6th floor unit is jacked up and fixed to the bracket $B_6$ of the designated floor.

During the seventh step, while the suspension rods 42 suspended from the jacks 38 are connected with and jacking up the 5th floor unit F5, the 4th floor units and the lower floors are connected sequentially on the ground floor in the same way as the second step. As a result, a multi-floor unit is formed by connecting the 5th floor unit $F_5$, the 4th floor unit $F_4$, and the 3rd floor unit $F_3$ as shown in FIG. 11(1).

Then after jacking up the multi-floor unit as a whole with the lifting jacks 38, each floor unit is fixed to the designated floor respectively. It is possible to remove the linking devices 44 and 48 that are used for forming the multi-floor unit after each floor unit is fixed the designated position; however, the linking devices 44 and 48 can be designed to form a part of the frame structure as well. Additionally, braces 50 can be attached in between each floor unit for reinforcing the frame structure at an appropriate timing. Then, the series of frame building operation with respect to the side portion 18 is completed after removing the lifting jacks 38, the suspension portions 32 shown in FIG. 5, the jack bases 40 shown in FIG. 6 and other unnecessary elements. The same process is used for building the side portion 18 of the other quadrants as well.

As explained in details, according the method of building a boiler flame in this embodiment, after the multi-floor unit $F_8$-$F_6$ connected on the grand floor as a whole is lifted up by the lifting jack 38 during the second step, each floor unit $F_3$-$F_5$ is fixed to the designate floor position respectively. In the same way, after the multi-floor unite $F_5$-$F_2$ is jacked up with the lifting jack 38, each floor unit is fixed to the designated floor position respectively. The pre-fabricated floor units, when made in a factory with an environment designed for maximum output on the ground are fixed to the respective designated floors efficiently. Furthermore, the restrictions of weight and size for the floor units $F_9$-$F_2$ are relaxed and also the method of building a boiler frame where the efficiency of the operation is influenced by a bad weather is no longer a problem, since there is no need to use the high load-lifting height crane in the second step and after.

Moreover, during the first and fourth step, the heavily loaded multi-floor unit can be jacked up since the steel frame structure is reinforced by the temporary fixation of the floor unit $F_9$ or the floor unit $F_6$ in the intermediate floor location of the steel supporting posts 20. As a result, a safe and efficient method of building a boiler frame is achieved.

In the embodiment explained in the case of one floor of the floor unit $F_9$ or the floor unit F6 alone is fixed to the steel supporting posts 20 temporarily. However, it should be born in mind that the present invention is not limited to the features in the embodiment and therefore multiple of floor can be fixed temporarily while building the boiler frame as needed.

Moreover, the embodiment is based upon the side portion 18 that is a portion of the whole boiler frame. However, it should be born in mind that this invention is not limited to the embodiment and is applicable to other portion of the boiler frame structure without any restriction.

While the invention herein disclosed has been described by means of specific embodiments and applications thereof, numerous modifications and variations can be made thereto by those skilled in the art without departing from the scope of the invention set forth in the claims.

What is claimed is:

1. A method of building a boiler frame comprising the steps of:

extending supporting posts to a top level, a top floor unit being temporarily fixed to a height corresponding to an intermediate floor level between the supporting posts, a top of the supporting posts being connected by beams to form a top area;

installing a lifting jack on the top area, the lifting jack being connected to the top floor unit and an intermediate floor unit with a traction device suspended from the lifting jack;

forming a multi-floor unit by linking the intermediate floor unit and at least one lower floor unit with a linking device;

lifting the multi-floor unit with the traction device to a floor level below the top floor unit;

connecting the top floor unit to the multi-floor unit with the linking device;

temporarily fixing the lower floor unit to the supporting posts at a middle position prior to disengaging the lower floor unit from the multi-floor unit;

releasing the temporary fixation of the top floor unit from the supporting posts;

jacking up the top floor unit and the multi-floor unit excluding the lower floor unit; and permanently fixing the top floor unit and each floor of the multi-floor unit to respective designated positions.

2. The method of building a boiler as claimed in claim 1, wherein the lifting jack is a center hole type lifting jack.

* * * * *